US005983923A

United States Patent [19]

Hobbs et al.

[11] Patent Number: 5,983,923

[45] Date of Patent: Nov. 16, 1999

[54] WATER SERVICE BOX AND CONNECTORS FOR PEX PIPE

[75] Inventors: Billy J. Hobbs, Gardnerville; Philip A. Mulvey, Carson City, both of Nev.

[73] Assignee: LSP Products Group, Inc., Carson City, Nev.

[21] Appl. No.: 08/833,883

[22] Filed: Apr. 10, 1997

Related U.S. Application Data

[60] Provisional application No. 60/015,172, Apr. 10, 1996.

[51] Int. Cl.[6] ..... F16L 35/00

[52] U.S. Cl. ..... 137/360; 251/148; 285/354; 285/174

[58] Field of Search ..... 137/360; 251/148; 285/354

[56] References Cited

U.S. PATENT DOCUMENTS

| | | | |
|---|---|---|---|
| 100,665 | 3/1870 | Potter . | |
| 1,553,164 | 9/1925 | Hook . | |
| 1,620,114 | 3/1927 | Loughead . | |
| 1,676,036 | 7/1928 | Levitt . | |
| 1,786,489 | 12/1930 | Hopkins . | |
| 1,825,005 | 9/1931 | Loughead . | |
| 1,987,100 | 1/1935 | Dick | 285/86 |
| 2,024,507 | 12/1935 | Brunner | 285/84 |
| 2,430,921 | 11/1947 | Edelmann | 29/148.2 |
| 2,443,394 | 6/1948 | LeClair | 285/86 |
| 2,481,001 | 9/1949 | Burckle | 285/84 |
| 2,521,127 | 9/1950 | Price . | |
| 2,672,924 | 3/1954 | Anthes | 158/27.4 |
| 2,830,618 | 4/1958 | Mitchell | 137/599 |
| 2,952,271 | 9/1960 | Dick et al. | 137/360 |
| 3,167,333 | 1/1965 | Hall et al. | 285/140 |
| 3,184,256 | 5/1965 | Zavertnik | 285/12 |
| 3,338,597 | 8/1967 | Mason | 285/52 |
| 3,381,982 | 5/1968 | Elek | 285/156 |
| 3,482,859 | 12/1969 | Bowlin | 285/332.3 |
| 3,533,649 | 10/1970 | Williams | 285/174 |
| 3,751,002 | 8/1973 | Folkerts et al. | 251/148 |
| 3,831,624 | 8/1974 | Doumany | 137/360 |
| 3,831,983 | 8/1974 | Stickler | 285/12 |
| 3,834,781 | 9/1974 | Logsdon | 312/229 |
| 4,069,837 | 1/1978 | Jirasek | 137/360 |

(List continued on next page.)

FOREIGN PATENT DOCUMENTS

| | | | |
|---|---|---|---|
| 228439 | 1/1959 | Australia . | |
| 535526 | 2/1955 | Belgium . | |
| 868792 | 4/1971 | Canada | 285/41 |
| 0085329 A2 | 1/1983 | European Pat. Off. . | |
| 0085329 B1 | 9/1986 | European Pat. Off. . | |
| 0490854 A2 | 12/1991 | European Pat. Off. . | |
| 0490854 A3 | 12/1991 | European Pat. Off. . | |
| 0085329 B2 | 10/1992 | European Pat. Off. . | |
| 2110739 | 10/1970 | France . | |
| 57-46816 | 3/1982 | Japan . | |
| 2148437 | 9/1983 | United Kingdom . | |

OTHER PUBLICATIONS

VersaFit Product Brochure, 1992, pp. 20–23.

FluidMaster Product (No–Burst) Brochure, 1992, pp. 11–19.

LSP Plumbing Specialities Catalog, 1995, 3 pages.

Vanguard Catalog Sheets, PEX Products, FailSafe & Heat–Link, 3 pages 1996.

Vanguard *Vanex Cross–linked Polyethylene* Catalog, 1996, 6 pages.

LSP Specialty Products company CPVC Valve Disclosure, 1994, 3 pages.

*Primary Examiner*—A. Michael Chambers
*Attorney, Agent, or Firm*—Monty L. Ross

[57] ABSTRACT

A plumbing connector system having a recessed, in-wall water service box, at least one valve connected to the water service box, and connector fittings particularly adapted for use in connecting in-wall potable water supply lines made of Cross linked polyethylene (PEX) to appliances and fixtures such as washing machines, ice makers, sinks, and the like. A valve inlet extension having a barbed end is disclosed for use in releasably securing the valve to the water service box and for connecting the valve to the Cross linked polyethylene water supply line.

10 Claims, 2 Drawing Sheets

U.S. PATENT DOCUMENTS

| | | | |
|---|---|---|---|
| 4,564,249 | 1/1986 | Logsdon | 312/229 |
| 4,589,688 | 5/1986 | Johnson | 285/12 |
| 4,591,194 | 5/1986 | Tash | 285/249 |
| 4,614,208 | 9/1986 | Skarelius | 138/103 |
| 4,660,860 | 4/1987 | Todd | 285/12 |
| 4,679,828 | 7/1987 | Bernardot | 285/175 |
| 4,682,797 | 7/1987 | Hildner | 285/40 |
| 4,716,925 | 1/1988 | Prather | 137/360 |
| 4,724,178 | 2/1988 | Hyodo et al. | 428/36 |
| 4,802,695 | 2/1989 | Weinhold | 285/91 |
| 4,865,072 | 9/1989 | Logsdon | 137/360 |
| 4,905,736 | 3/1990 | Kitami et al. | 138/137 |
| 4,911,406 | 3/1990 | Attwood | 251/148 |
| 4,927,184 | 5/1990 | Bourjot et al. | 285/21 |
| 4,934,410 | 6/1990 | Humber | 137/360 |
| 4,942,906 | 7/1990 | Igarashi et al. | 138/126 |
| 4,991,876 | 2/1991 | Mulvey | 285/21 |
| 5,009,247 | 4/1991 | Oberdorfer | 137/218 |
| 5,024,419 | 6/1991 | Mulvey | 251/148 |
| 5,029,606 | 7/1991 | Kuhlthau | 137/360 |
| 5,060,689 | 10/1991 | Csaszar | 137/515 |
| 5,060,988 | 10/1991 | Williamson | 285/332.3 |
| 5,098,134 | 3/1992 | Monckton | 285/38 |
| 5,105,854 | 4/1992 | Cole et al. | 138/109 |
| 5,143,381 | 9/1992 | Temple | 277/1 |
| 5,165,727 | 11/1992 | Valley | 285/12 |
| 5,169,122 | 12/1992 | Sunderland | 251/148 |
| 5,264,262 | 11/1993 | Igarashi | 428/36.9 |
| 5,282,652 | 2/1994 | Werner | 285/55 |
| 5,284,184 | 2/1994 | Noone et al. | 138/121 |
| 5,305,785 | 4/1994 | Humber | 137/360 |
| 5,332,160 | 7/1994 | Ruskin | 239/542 |
| 5,334,064 | 8/1994 | Ketterman | 441/42 |
| 5,348,779 | 9/1994 | Igarashi | 428/36.7 |
| 5,349,988 | 9/1994 | Walsh et al. | 138/107 |
| 5,364,134 | 11/1994 | Anderson | 285/38 |
| 5,364,135 | 11/1994 | Anderson | 285/38 |
| 5,375,887 | 12/1994 | Johnson | 285/12 |
| 5,482,076 | 1/1996 | Taylor et al. | 137/318 |
| 5,546,978 | 8/1996 | Parker | 137/315 |
| 5,566,708 | 10/1996 | Hobbs, Jr. | 251/148 |
| 5,615,703 | 4/1997 | Kopp | 251/148 |
| 5,622,210 | 4/1997 | Crisman et al. | 138/104 |
| 4,158,471 | 6/1979 | Logsdon | 312/229 |
| 4,159,027 | 6/1979 | Caillet | 138/127 |
| 4,162,092 | 7/1979 | Hayes | 285/39 |
| 4,313,629 | 2/1982 | Winterhalter | 285/242 |
| 4,332,402 | 6/1982 | Shellhause | 285/86 |
| 4,548,430 | 10/1985 | Haubert et al. | 285/256 |

WATER SERVICE BOX AND CONNECTORS FOR PEX PIPE

CROSS REFERENCE TO RELATED APPLICATIONS

This application claims priority based on Provisional application Ser. No. 60/015,172 filed Apr. 10, 1996.

BACKGROUND OF THE INVENTION

1. Field of the Invention

This application relates to plumbing apparatus, and more particularly, to a plumbing connector system that is useful for connecting in-wall potable water supply lines to plumbing fixtures and appliances.

2. Description of Related Art

Cross linked polyethylene (PEX) tubing and various connector fittings have previously been used by the building industry as an alternate way to heat homes and to keep driveways and steps clear of snow and ice. More recently, builders have begun to use PEX tubing for the potable water systems in homes, replacing the use of copper tubing. The valves presently available for use with PEX potable water tubing are typically angle stops that are stubbed in through the wall.

A connection device said to be useful for outlet fittings in an installation for conveying water for industrial or domestic use is disclosed in EP 0 085 329 B1. This publication discloses flexible pipe lines laid in dummy pipes in a building, having a connection piece secured under the wall surface in a connection box. The flexible pipe lines are said to be made of plastics, preferably PEX, and means are disclosed for joining the pipe lines to the connection piece. Plumbing connector systems utilizing various connector fittings for attaching water service boxes to chlorinated polyvinyl chloride (CPVC) water supply lines have also been disclosed. Such systems are believed to have been marketed by Oatey and IPS.

SUMMARY OF THE INVENTION

The invention disclosed herein is a plumbing connector system comprising a recessed, in-wall water service box, at least one valve having an inlet extension connected to the water service box, and connector fittings particularly adapted for use in connecting in-wall potable water supply lines made of PEX to the valve inlet extension. The valve outlet can comprise any conventional means useful for connecting a valve to appliances and fixtures such as washing machines, ice makers, sinks, and the like, using flexible hose or tubing with conventional fittings. Water service boxes used in such applications typically comprise one or more valves and optionally, depending upon the use, single or multiple waste drains.

According to one preferred embodiment of the invention, the valve inlet extension of the subject connector system has an externally threaded male end that threadedly engages the valve inlet, a hexagonal flange section for use in tightening and untightening the valve inlet extension relative to the valve inlet; an externally threaded section for use in securing the valve inlet extension and valve to the water service box, and a barbed end for attachment to a PEX water supply line. The barbed end of the valve inlet extension can be integrally formed at the end of the extension that is opposite the inlet valve, or can be separately made as an adapter and then attached to a male iron pipe (MIP) valve extension.

According to another preferred embodiment of the invention, the barbed end of the valve inlet extension is attached to the free end of a PEX water supply line using a metal crimp ring.

According to another preferred embodiment of the invention, the barbed end of the valve inlet extension is attached to the free end of a PEX water supply line using a PEX crimp ring.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
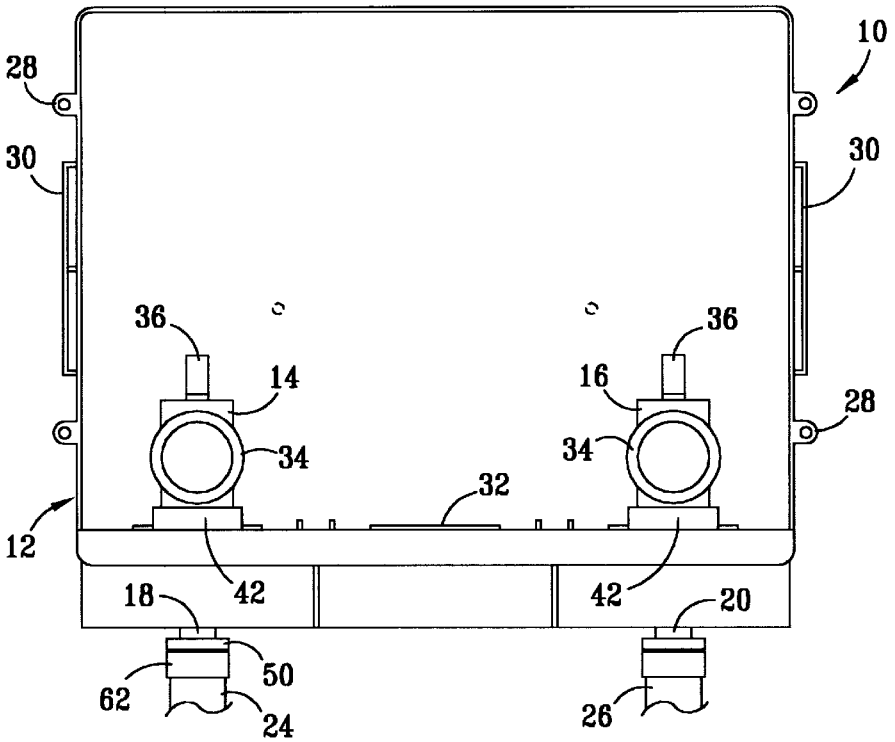
FIG. 1 is a simplified front elevation view of a water service box having two water inlet valves, each being connected to a PEX water supply line.
Figure 2:
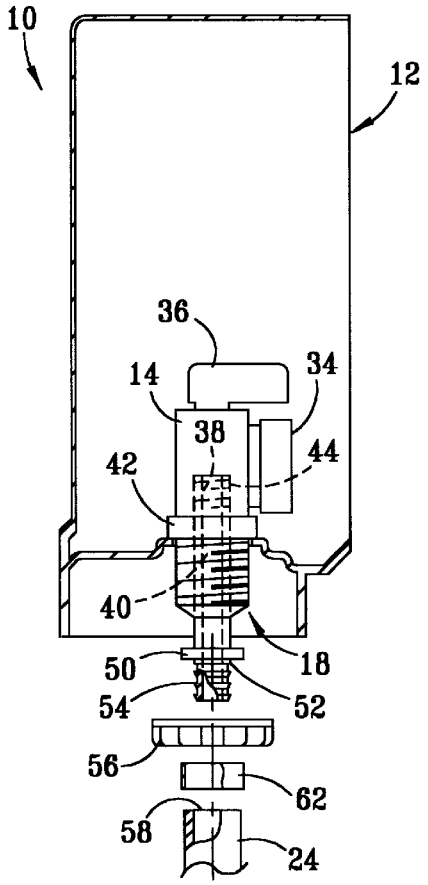
FIG. 2 is a side elevation view of the water service box of FIG. I with the connection to the PEX water supply line below the box exploded to better illustrate its parts.

Referring to FIGS. 1 and 2, one preferred connector system 10 of the invention preferably comprises a recessed, in-wall water service box 12, valves 14, 16 having threadedly engaged valve inlet extensions 18, 20 connected to water service box 12, and connector fittings as described below particularly adapted for use in connecting in-wall potable water supply lines 24, 26 made of PEX to the barbed ends of valve inlet extensions 18, 20. Water service boxes useful for practicing the invention are typically made of plastic or metal and are commercially available in a variety of different configurations depending, for example, on the intended application, the number of valves needed, and whether or not a waste water drain is also needed. Water service box 12 as shown is a molded plastic box having top, bottom, back and side walls, and an overall depth such that it can be recessed in a wall and attached to studs for support. Nails, screws or other fasteners can be inserted through ears 28; alternatively, where the stud spacing is such that ears 28 cannot be directly attached to a stud, brackets 30 are provided on each side of box 12 through which conventional extension pieces (not shown) can be inserted for attachment to stud(s) spaced away from the sides of box 12. Knockouts 32 are desirably provided in the bottom of box 12, and boxes can also be made having knockouts in the sides, back or top walls if desired. Many water service boxes are made with concentrically disposed knockouts of different diameters to permit removal of one knockout to facilitate attachment of a valve and a different knockout to facilitate insertion or attachment of a waste drain line. Although not shown in the drawings, faceplates that snap on or otherwise attach to the front of water service boxes are well known.

Valves 14, 16 are depicted as quarter turn ball valves, but those of ordinary skill in the art will appreciate upon reading this disclosure that other types of valves can also be used within the scope of the invention provided they are constructed in such manner as to permit use within the confines of water service box 12. Brass is a preferred material for use in fabricating valves 14, 16 and valve inlet extensions 18, 20 for use in the present invention, although other metal and plastic materials can also be used. Other metals useful for particular applications as valve inlet extensions 18, 20 include without limitation stainless steel, steel aluminum, and copper. Other plastics potentially useful as valve inlet extensions 18, 20 together with plastic valves include without limitation filled polyethylene, filled polypropylene, and polysulfone. Viewed externally, each valve 14, 16 typically comprises an outlet port 34, handle mechanism 36 for actuating the valve, and inlet port 38 and valve inlet extension 18 that is preferably threaded into inlet port 38. Alternatively, depending upon the materials used to make valve 14, 16 and valve inlet extensions 18, 20, the extension can be attached to the valve by gluing, soldering, or ultrasonic welding.

Figure 5:
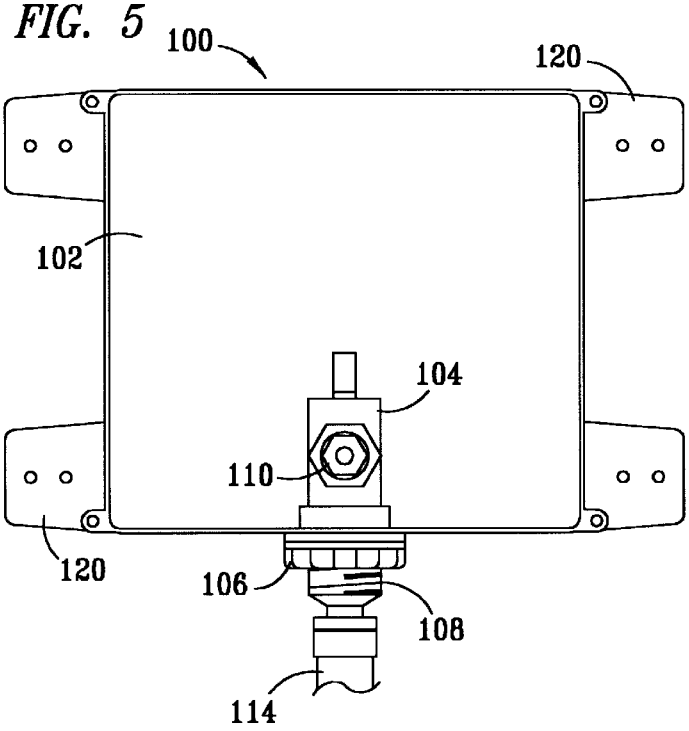
FIG. 5 is a simplified front elevation view of a different style water service box having a single valve with a different style outlet and an inlet valve extension connected to a PEX water supply line.
Figure 6:
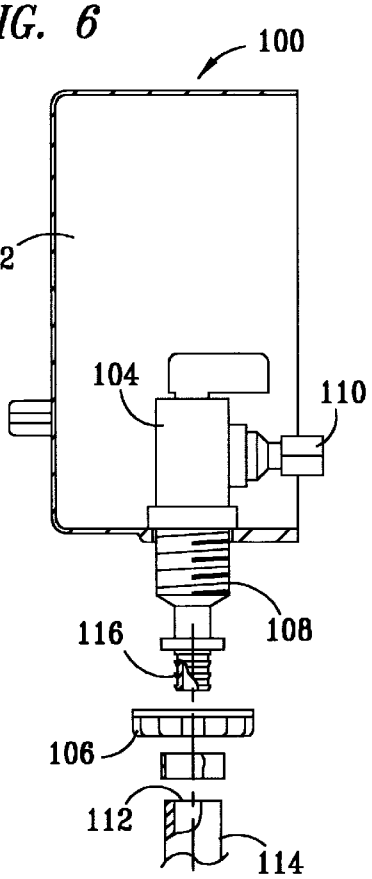
FIG. 6 is a side elevation view of the water service box of FIG. 5 with the connection to the PEX water supply line below the box exploded to better illustrate its parts.

Valve inlet extension 18 preferably comprises a centrally disposed, longitudinal bore 40, an external hexagonal flange section 42 used to tighten male threaded end 44 into watertight engagement with female threads 46 inside valve inlet port 38, an externally threaded section 48 below hexagonal flange 42, a lower flange 50 comprising an annular shoulder 52, and a barbed end section 54 below annular shoulder 52 of lower flange 50. The transverse dimension of hexagonal flange 42 is desirably great enough large enough to support valve 14 above a coaxially aligned opening through a wall, here the bottom wall, of water service box 12, while the outside diameter of externally threaded section 48 is desirably slightly less than the diameter of the opening to permit attachment of a threaded locknut 56 that will releasably secure valve inlet extension 18 to water service box 12. Although use of a threaded locknut 56 is disclosed herein for releasably securing valve inlet extension 18 to water service box 12, it will be apparent that other similarly effective means such as push-nuts, clips, E-rings, and the like, can also be used within the scope of the invention. Alternatively, valve 14 and valve inlet extension 18 can be permanently attached to a water service box by means such as gluing if desired. Annular shoulder 52 is desirably provided adjacent to barbed end section 54 to limit insertion of the barbed end into free end 58 of PEX water supply line 24. Outlet port 34 as shown in FIGS. 1 and 2 is a conventional, internally threaded female valve outlet port suitable for connection to an externally threaded male connector fitting of the type known for use with a flexible connector hose or tubing (not shown), although it will be appreciated that an outlet port having an externally threaded male connection or a rotatable, female threaded hexagonal connector 60 as shown in FIGS. 5 and 6 can also be used within the scope of the invention.

Prior to pushing free end 58 of PEX water supply line 24 over barbed end 54 of valve inlet extension 18 as shown in FIG. 1, metal ring 62 as shown in FIG. 2 having a diameter slightly greater than the outside diameter of line 24 is desirably slipped over free end 58. Once free end 58 is in place over barbed end 54, metal ring 62 is positioned around barbed end 54, and crimped into place to complete the attachment of line 24 to valve 14. This means of attachment is typically preferred for use with PEX pipe or tubing made by the so-called "Silane" method.

Figure 3:
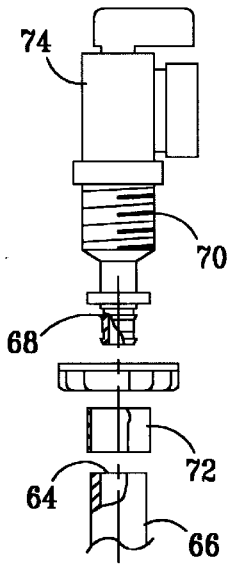
FIG. 3 is an exploded side elevation view depicting a different connector fitting for attaching the valve inlet extension to a PEX water supply line.

According to another embodiment of the invention as shown in FIG. 3, free end 64 of PEX water supply line 66 is connected to barbed end 68 of valve inlet extension 70 using a PEX ring 72. According to this embodiment, which is typically preferred for use with PEX pipe made by the so-called "Engle" method, PEX ring 72 is slipped over end 64, and a tool is used to spread the inside diameter of end 64 and ring 72 so that barbed end 68 of valve inlet extension 70 can be inserted into end 64. Once end 64 and ring 72 are in place over barbed end 68, ring 62 relaxes around barbed end 68 to hold end 64 of PEX water supply line 66 in place relative to valve 74.

Figure 4:
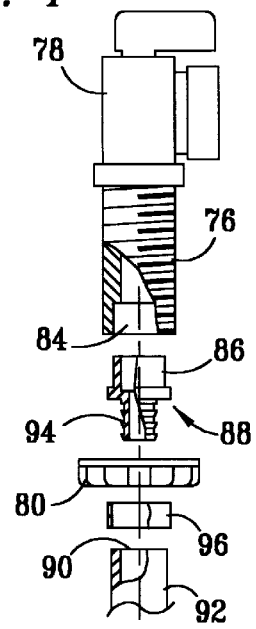
FIG. 4 is an exploded side elevation view depicting a valve with a male iron pipe extension, a barbed adapter and a connector fitting for attaching the male iron pipe extension to a PEX water supply line.

According to another embodiment of the invention as shown in FIG. 4, a male iron pipe (MIP) valve inlet extension 76 is threaded into the inlet side of valve 78. This MIP nipple desirably has external threads useful for securing it to a water service box using locknut 80. Lower end 82 of extension 76 desirably has a recessed counterbore 84 into which unbarbed end 86 of barbed adapter 88 is pressed and secured by means such as soldering. It will be appreciated, of course that other means of attachment such as threads, glue, welding, and the like, can also be used depending upon the materials of construction. Free end 90 of PEX water supply line 92 can then be attached to barbed end 94 using metal ring 96 as shown or by using a PEX ring as disclosed in FIG. 3, as appropriate.

Referring to FIGS. 5 and 6, connector system 100 of the invention comprises water service box 102 having a single valve 104 releasably secured inside it by locknut 106 threadedly engaging valve inlet extension 108 as described above. A rotatable threaded nut 110 is provided on the outlet side of valve 104 for attachment to a male threaded end fitting of a flexible hose connector (not shown). Free end 112 of PEX water supply line 114 can be attached to barbed end 116 of valve inlet extension 118 using either of the methods and apparatus previously described in relation to FIGS. 2 and 3 above. Water service box 102 illustrated in this embodiment is provided with a plurality of ears 120 for use in attaching box 102 to supporting studs (not shown) within a wall.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A plumbing connector system comprising:

A recessed, in-wall water service box having top, bottom, back and side walls, and at least one opening through one of the walls that is adapted to receive a valve inlet extension of desired diameter through the opening;

At least one valve operable inside the water service box, the valve having an inlet and an outlet;

A valve inlet extension attached to the valve in fluid communication with the valve inlet and extending through the opening in the water service box, the valve inlet extension having a barbed end opposite the valve inlet, the barbed end having a longitudinal bore and being insertable into an open end of a cross-linked polyethylene water supply line, the outside diameter of the barbed end being sized to frictionally engage the cross-linked polyethylene water supply line when inserted therein;

Apparatus releasably securing the valve inlet extension to the wall of said water service box having said opening; and A ring positionable over and around said end of the cross-linked polyethylene water supply line to secure said end to the barbed end of the valve inlet extension.

2. The plumbing connector system of claim 1 wherein the valve inlet extension threadedly engages the valve inlet.

3. The plumbing connector system of claim 1 wherein the barbed end is formed as an integral part of the valve inlet extension.

4. The plumbing connector system of claim 1 wherein the barbed end is part of an adaptor connected to an end of the valve inlet extension opposite the valve inlet.

5. The plumbing connector system of claim 1 wherein the apparatus comprises an externally threaded portion of the valve inlet extension extending through the opening in combination with a threaded locknut.

6. The plumbing connector system of claim 1 wherein the ring is a metal crimp ring.

7. The plumbing connector system of claim 1 wherein the ring is made of cross-linked polyethylene.

8. The plumbing connector system of claim 1 wherein the water service box further comprises at least one waste drain opening.

9. The plumbing connector system of claim 1 wherein the valve inlet extension comprises a hexagonal flange section disposed above the opening, the flange section having a transverse dimension greater than the diameter of the opening.

10. The plumbing connector system of claim 1 wherein the valve inlet extension comprises an annular shoulder adjacent to the barbed end that limits insertion of the barbed end into the cross-linked polyethylene water supply line.

* * * * *